US008459631B2

(12) United States Patent
Ishikawa et al.

(10) Patent No.: US 8,459,631 B2
(45) Date of Patent: Jun. 11, 2013

(54) SHEET PROCESSING APPARATUS

(75) Inventors: Naoki Ishikawa, Kashiwa (JP); Yasuo Fukatsu, Abiko (JP); Hitoshi Kato, Toride (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/098,059

(22) Filed: Apr. 29, 2011

(65) Prior Publication Data

US 2011/0280689 A1 Nov. 17, 2011

(30) Foreign Application Priority Data

May 17, 2010 (JP) ..... 2010-113562

(51) Int. Cl.
*B31F 1/00* (2006.01)

(52) U.S. Cl.
USPC ..... 270/51; 270/32; 270/37; 270/45; 270/58.07; 270/58.08

(58) Field of Classification Search
USPC ..... 270/32, 37, 45, 51, 58.07, 58.08, 270/58.09; 493/406, 442, 454
See application file for complete search history.

(56) References Cited

U.S. PATENT DOCUMENTS

| | | | | |
|---|---|---|---|---|
| 7,147,598 | B2 * | 12/2006 | Fujimoto et al. | 493/405 |
| 7,673,862 | B2 * | 3/2010 | Kushida et al. | 270/32 |
| 2005/0274252 | A1 * | 12/2005 | Wakabayashi et al. | 83/697 |
| 2009/0008856 | A1 * | 1/2009 | Kushida et al. | 270/20.1 |
| 2009/0103962 | A1 * | 4/2009 | Fujii et al. | 399/404 |
| 2010/0258994 | A1 * | 10/2010 | Kikkawa et al. | 270/37 |
| 2011/0103919 | A1 * | 5/2011 | Furuhashi et al. | 412/1 |

FOREIGN PATENT DOCUMENTS

JP 2003-182928 A 7/2003

* cited by examiner

*Primary Examiner* — Leslie A Nicholson, III
(74) *Attorney, Agent, or Firm* — Canon USA, Inc., IP Division

(57) ABSTRACT

A sheet processing apparatus includes a sheet stacking unit, a binding unit, a folding unit, a conveyance unit, a press unit, a grasping unit, and a control unit. The binding unit performs binding processing on a sheet bundle stacked in the sheet stacking unit. The folding unit folds the sheet bundle that is subjected to binding processing. The conveyance unit conveys the folded sheet bundle. The press unit presses a fold line portion of the conveyed sheet bundle. The grasping unit is separate from the conveyance unit and switches between a first state in which the grasping unit grasps the conveyed sheet bundle to fix the sheet bundle in position and a second state in which the grasping unit does not grasp the conveyed sheet bundle. The control unit shifts the grasping unit to the first state and causes the press unit to press the sheet bundle.

10 Claims, 15 Drawing Sheets

FIG. 7

| NUMBER OF BUNDLE SHEETS | PRESS UNIT MOVEMENT SPEED |
|---|---|
| 2 TO 4 SHEETS | V1 |
| 5 TO 9 SHEETS | V2 |
| 10 TO 14 SHEETS | V3 |
| 15 TO 19 SHEETS | V4 |
| 20 TO 25 SHEETS | V5 |

※ V1 > V2 > V3 > V4 > V5

FIG.15A

| SHEET BUNDLE | SQUEEZING SETTING | CLAMPING OPERATION | PROCESSING ON FOLD LINE PORTION |
|---|---|---|---|
| LESS THAN 10 SHEETS | — | NOT EFFECTED | PRESSING |
| 10 SHEETS OR MORE | NOT EFFECTED | EFFECTED | PRESSING |
| | EFFECTED | EFFECTED | PRESSING + SQUEEZING |

FIG.15B

| SHEET BUNDLE | SQUEEZING SETTING | CLAMPING OPERATION | PROCESSING ON FOLD LINE PORTION |
|---|---|---|---|
| LESS THAN 8 SHEETS | — | NOT EFFECTED | PRESSING |
| MORE THAN 8 SHEETS AND LESS THAN 10 SHEETS | — | EFFECTED | PRESSING |
| 10 SHEETS OR MORE | NOT EFFECTED | EFFECTED | PRESSING |
| | EFFECTED | EFFECTED | PRESSING + SQUEEZING |

FIG.15C

| SHEET BUNDLE | SQUEEZING SETTING | CLAMPING OPERATION | PROCESSING ON FOLD LINE PORTION |
|---|---|---|---|
| LESS THAN 10 SHEETS | — | NOT EFFECTED | PRESSING |
| MORE THAN 10 SHEETS AND LESS THAN 12 SHEETS | NOT EFFECTED | NOT EFFECTED | PRESSING |
| | EFFECTED | EFFECTED | PRESSING + SQUEEZING |
| 10 SHEETS OR MORE | NOT EFFECTED | EFFECTED | PRESSING |
| | EFFECTED | EFFECTED | PRESSING + SQUEEZING |

SHEET PROCESSING APPARATUS

BACKGROUND OF THE INVENTION

1. Field of the Invention

The present invention relates to a sheet processing apparatus which functions to apply saddle stitching and folding in the middle to a plurality of sheets.

2. Description of the Related Art

There has been widely provided a sheet processing apparatus which can perform bookbinding including saddle stitching processing and mid-folding processing on a sheet bundle containing a large number of sheets that have undergone image formation by an image forming apparatus. When mid-folding processing is performed on a sheet bundle by such a sheet processing apparatus, it can happen that the fold line portion of the sheet bundle is not properly folded, so that the folded sheet bundle swells and looks rather unsatisfactory. In particular, when the number of sheets is large or in the case of thick sheets, the fold line portion may be easily opened.

To solve the above issue, in Japanese Patent Application Laid-Open No. 2003-182928, after the fold line portion has been formed through mid-folding processing, a press roller is moved in a direction orthogonal to a sheet conveyance direction while pressing the fold line portion. The pressing helps to properly fold the fold line portion and improve an outward appearance of a booklet prepared.

However, when the fold line portion of the sheet bundle that has undergone saddle stitching and mid-folding is pressed by the press roller, it can happen that, due to the pressure applied, the outermost sheet (cover) is pulled, with the result that sheet may be ripped in the vicinity of the binding portion. If, to prevent generation of such cover ripping, the pressing force of the press roller were reduced, it would be impossible to maintain the appearance quality of the fold line portion.

SUMMARY OF THE INVENTION

The present invention is directed to a sheet processing apparatus helping to solve the above issue. More specifically, the present invention is directed to a sheet processing apparatus capable of maintaining an appearance quality of a fold line portion of a sheet bundle subjected to saddle stitching without causing ripping of a sheet of the sheet bundle.

According to an aspect of the present invention, a sheet processing apparatus includes a sheet stacking unit in which a sheet bundle is stacked, a binding unit configured to perform binding processing on the sheet bundle stacked in the sheet stacking unit, a folding unit configured to fold the sheet bundle that is subjected to binding processing by the binding unit, a conveyance unit configured to convey the sheet bundle folded by the folding unit, a press unit configured to press a fold line portion of the sheet bundle conveyed by the conveyance unit, a grasping unit provided separately from the conveyance unit and configured to be switched between a first state in which the grasping unit grasps the conveyed sheet bundle so as to fix the sheet bundle in position and a second state in which the grasping unit does not grasp the conveyed sheet bundle, and a control unit configured to shift the grasping unit to the first state and to cause the press unit to press the sheet bundle.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 illustrates movement speeds of the press unit.

FIGS. 15A through 15C illustrate relationships between the number of sheets of a bundle, propriety of a clamping operation, and propriety of setting squeezing processing.

DESCRIPTION OF THE EMBODIMENTS

Various exemplary embodiments, features, and aspects of the invention will be described in detail below with reference to the drawings.

Figure 1:
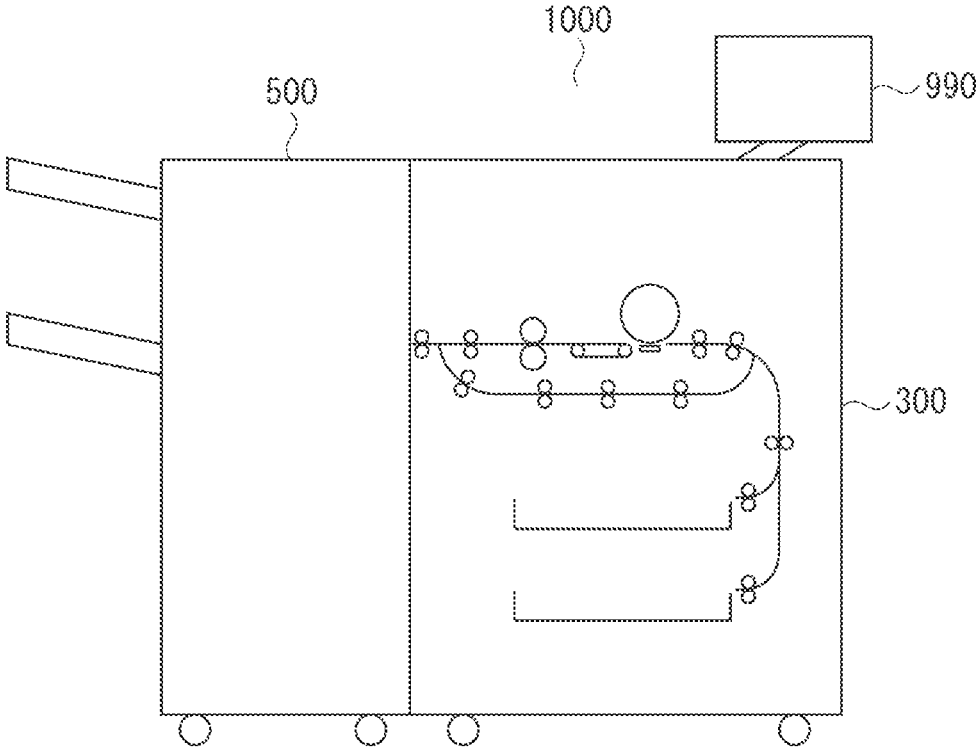
FIG. 1 is a sectional view of an image forming apparatus system.

FIG. 1 is a schematic front view of an image forming system to which a sheet processing apparatus according to a first exemplary embodiment is applicable. An image forming system 1000 includes a printer unit 300 and a finisher 500. The finisher 500 takes in a plurality of sheets that have undergone image forming by the printer unit 300, and performs thereon sheet processing such as saddle stitch book binding. The printer unit 300 is equipped with an operation unit 990 for displaying information to a user and inputting an instruction from the user.

Figure 2:
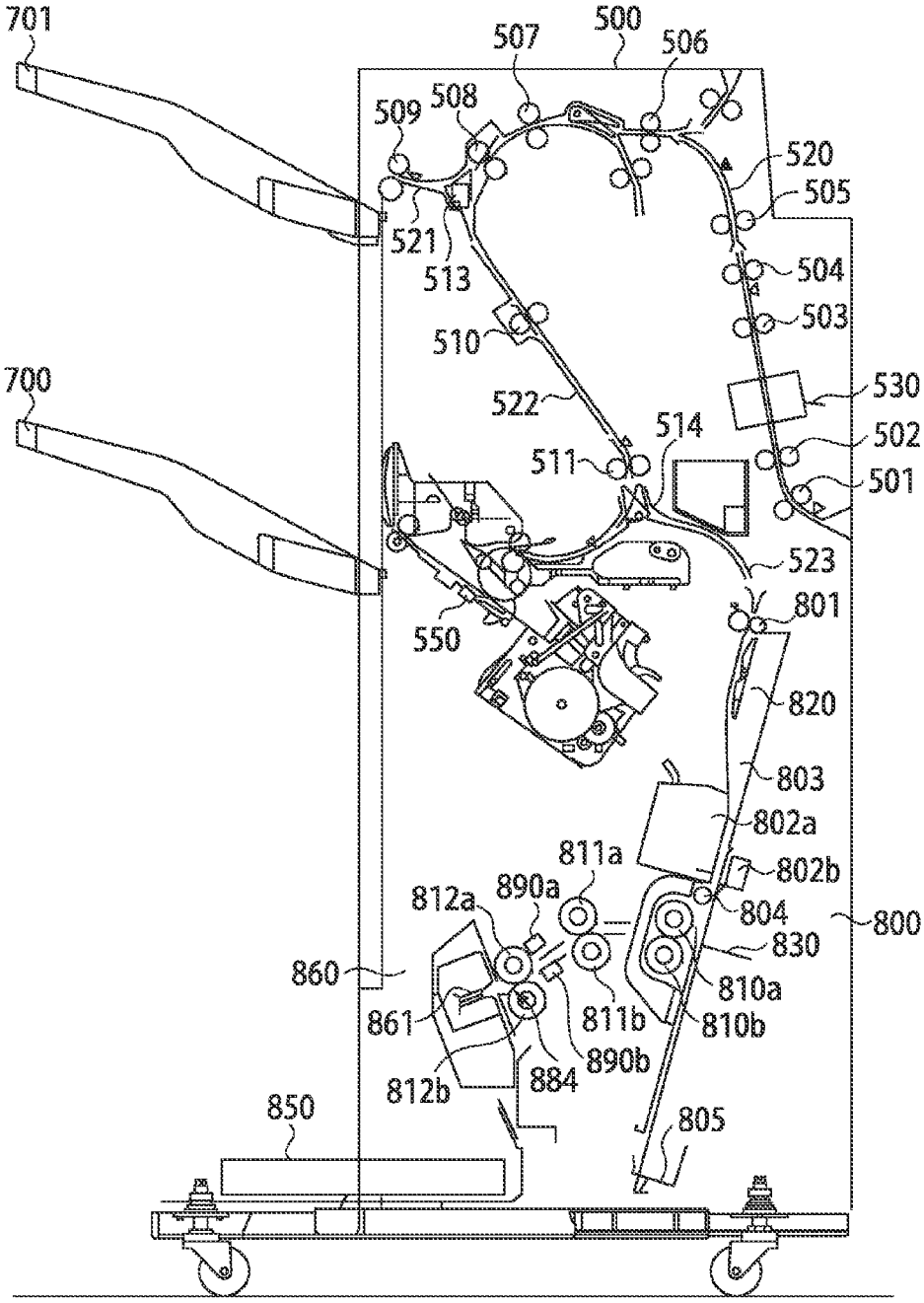
FIG. 2 is a sectional view of a finisher.

FIG. 2 is a sectional view illustrating the finisher 500 in detail. The finisher 500 has a conveyance path 520 for taking a conveyed sheet into an interior of the apparatus, and the conveyance path 520 is provided with an inlet roller 501 and conveyance rollers 502 through 508. Between the conveyance roller 502 and the conveyance roller 503, there is provided a punching unit 530. The punching unit 530 operates as needed, and performs hole making (punching) processing on a trailing edge portion of the sheet conveyed. A flapper 513 is provided on a downstream side of the conveyance roller 508, and switches a sheet conveyance destination between a sheet discharge path 521 and a sheet discharge path 522.

The sheet guided to the sheet discharge path 521 is discharged onto a stack tray 701 by a sheet discharge roller 509. On the other hand, the sheet discharge path 522 is provided with conveyance roller pairs 510 and 511 and a flapper 514. The flapper 514 switches the sheet conveyance destination between the side of a processing tray 550 and the side of a saddle stitch bookbinding unit 800. The sheets discharged onto the processing tray 550 undergo sorting processing, stapling processing, or the like, and are selectively discharged onto stack trays 700 and 701 vertically movable.

Next, the configuration of the saddle stitch bookbinding unit 800 will be described. The sheet conveyed to a saddle sheet discharge path 523 is delivered to a saddle inlet roller pair 801, and is conveyed into a processing tray 815 via an accommodation guide 803. A flapper 820 is provided at an inlet of the accommodation guide 803. The flapper 820 is operated by a solenoid (not illustrated) according to a sheet size, and selects a sheet carrying-in port. The sheet carried into the accommodation guide 803 is conveyed by a roller 804 until it abuts on a sheet positioning member 805. The saddle inlet roller pair 801 and the roller 804 are driven by a sheet conveyance motor 904.

A stapler 802 is arranged at a position facing to the accommodation guide 803, and is divided into a driver 802*a* for projecting a staple and an anvil 802*b* for bending the staple projected. The sheet positioning member 805 can be moved by a motor 905, and, at the time of carrying-in a sheet, it is moved in advance according to the sheet size so that a middle portion (in the conveyance direction) of the sheet comes to a stitching position of the stapler 802.

On the downstream side of the stapler 802, there are provided a folding roller pair 810 (including rollers 810*a* and 810*b*), and, at a position facing to the folding roller pair 810, there is provided a pushing member 830. When stapling is not performed on the sheet bundle, the pushing member is moved such that the middle portion (in the conveyance direction) of the sheets comes to a position facing to a nip portion of the folding roller pair 810. After the stapling is performed on the sheets, to perform folding processing on the sheet bundle stapled by the stapler 802, the sheet positioning member 805 is moved so that the stapling position of the sheet bundle comes to a nipping position of the folding roller pair 810.

The pushing member 830 is movable toward the nip portion of the folding roller pair 810, and is driven by a pushing motor 906. The pushing member 830 is projected toward the sheet bundle accommodated, so that the sheet bundle is folded while being pushed into the nip portion of the folding roller pair 810. In other words, the pushing member 830 and the folding roller pair 810 function as a folding unit for folding the sheet bundle. At this time, the folding roller pair 810 also rotates to convey the sheet bundle pushed in to the downstream. Then, the pushing member 830 is returned to a home position by the pushing motor 906. Between the folding roller pair 810, there is exerted by a spring (not illustrated) a pressure F1 large enough to give a fold line to the sheet bundle.

The sheet bundle with the fold line is conveyed by a first folding conveyance roller pair 811 (including rollers 811*a* and 811*b*) and a second folding conveyance roller pair 812 (including rollers 812*a* and 812*b*) serving as conveyance units to a press unit 860. Pressures F2 and F3 large enough to convey and stop the sheet bundle with the fold line are also applied to the first folding conveyance roller pair 811 and the second folding conveyance roller pair 812, respectively. The folding roller pair 810, the first folding conveyance roller pair 811, and the second folding conveyance roller pair 812 are rotated with constant velocity by the same folding conveyance motor 907.

Between the first folding conveyance roller pair 811 and the second folding conveyance roller pair 812, there are provided clamp members 890 (including members 890*a* and 890*b*) for holding the sheet bundle from both surfaces to grasp the same. The clamp member 890*a* moves with respect to the clamp member 890*b* to shift the sheet bundle between a first state in which the sheet bundle is grasped and a second state in which the sheet bundle is not grasped. The clamp members 890*a* is moved by a clamp motor 909. In other words, the clamp members 890 function as a grasping unit for grasping the sheet bundle.

On the downstream side of the second folding conveyance roller pair 812, there are provided a folded sheet bundle discharge tray 850 and the press unit 860. The press unit 860 has a press roller pair 861. The press roller pair 861 moves along the fold line portion while nipping the fold line portion, so that the fold line portion is pressed. As a result, the folding is strengthened. The processing performed on the fold line portion by the press roller pair 861 will be referred to as the pressing processing.

Figure 3:
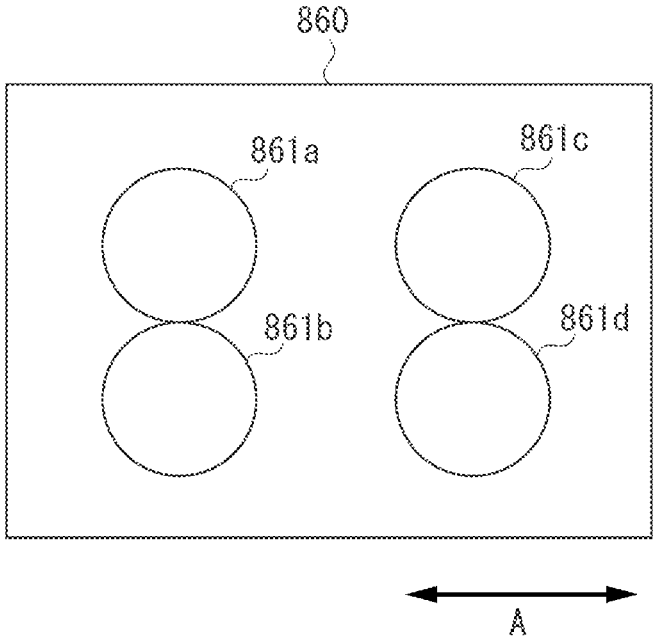
FIG. 3 is a plan view of a press unit.

FIG. 3 illustrates the press unit 860 as seen from the downstream side in the conveyance direction of the sheet bundle. As the press roller pair 861 of the press unit 860, there are provided two sets of press roller pairs, that is a press roller pair 861*a* and 861*b*, and a press roller pair 861*c* and 861*d*. The press roller pairs 861 of press unit 860 move in the direction of the arrow A (a direction perpendicular to the sheet bundle conveyance direction) along the fold line portion of the sheet bundle at rest, so that the two sets of press roller pairs respectively perform pressing processing, and the folded state of the fold line portion can be enhanced.

Figure 4:
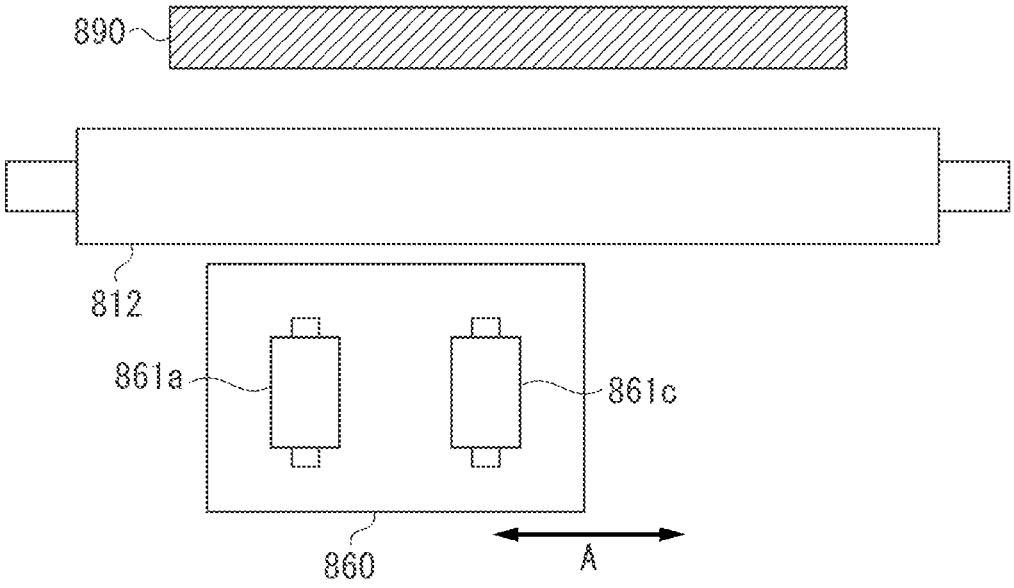
FIG. 4 is a plan view for illustrating pressing processing.

FIG. 4 is a plan view as seen from above of the press unit 860 and the portions in the vicinity thereof. On the upstream side of the second folding conveyance roller pair 812, there is provided the clamp member 890. The press unit 860 is provided on the downstream side of the second folding conveyance roller pair 812. The press unit 860 moves in the direction of the arrow A, so that the pressing processing is executed on the sheet bundle as described above.

Figure 5A:
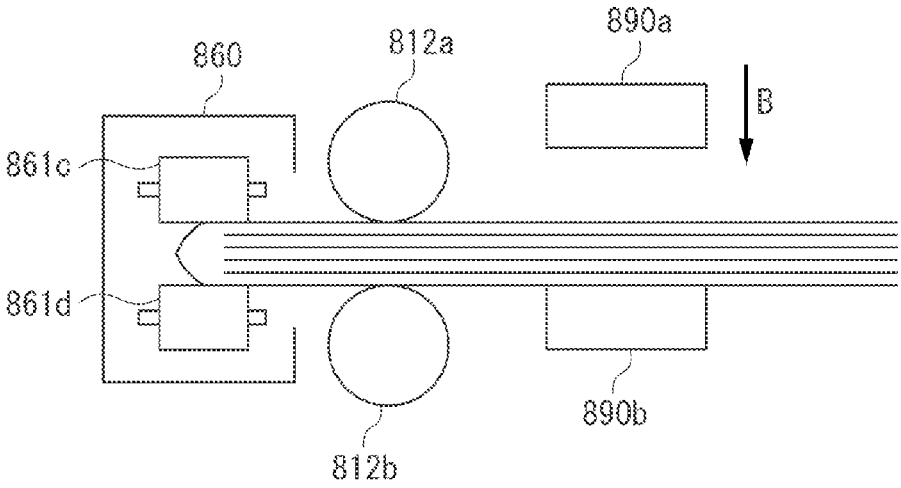
FIGS. 5A and 5B are sectional views for illustrating the pressing processing.
Figure 5B:
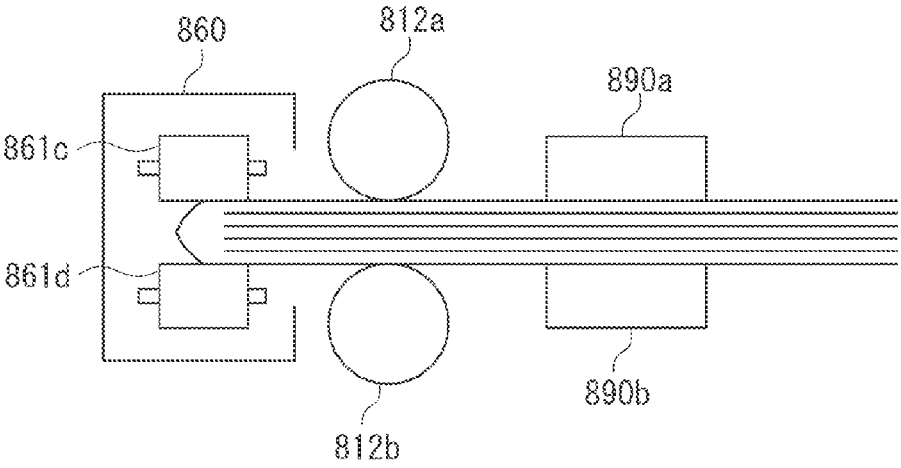

FIGS. 5A and 5B are sectional views of the press unit 860 and the portions in the vicinity thereof as seen from the front side. FIG. 5A illustrates a state in which the clamp members 890 are not clamping the sheet bundle. The clamp member 890*a* moves in the direction of the arrow B from the home position, which is a standby position, and clamps the sheet bundle as illustrated in FIG. 5B. A clamp sensor (not illustrated) detects that the clamp member 890*a* is situated at the home position.

Figure 6:
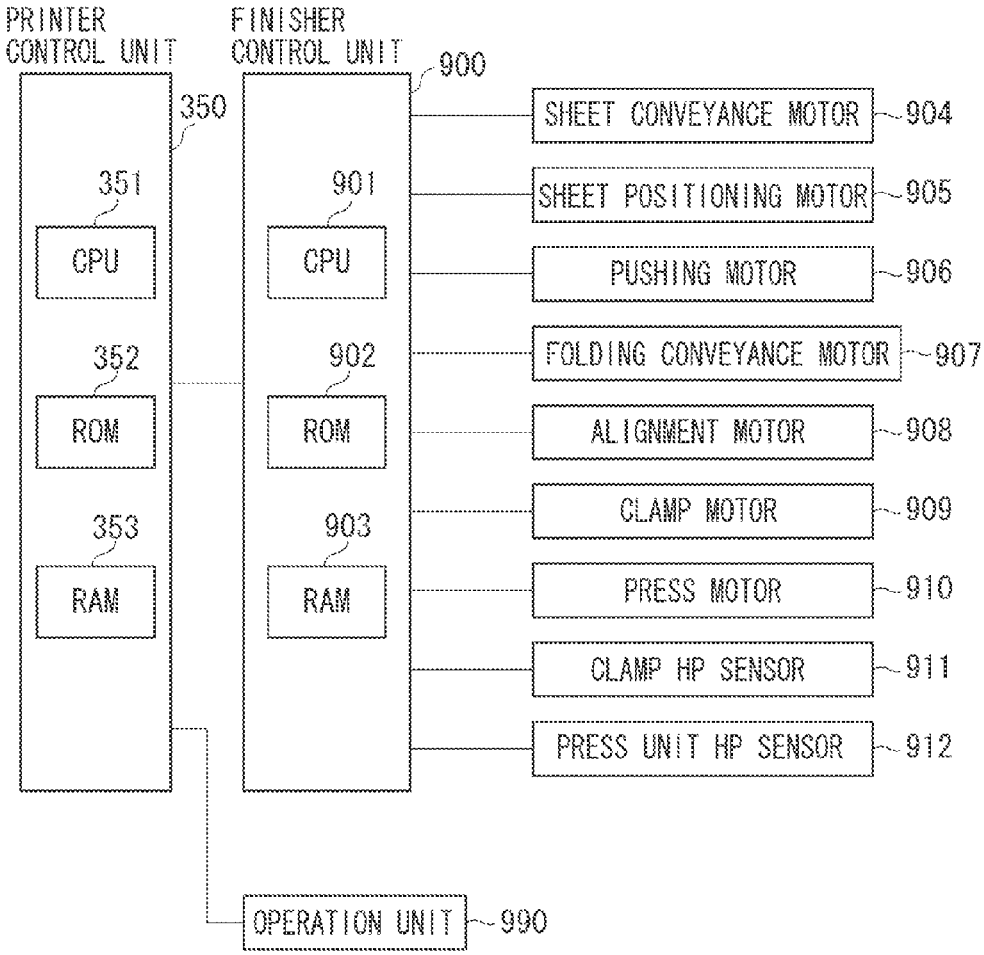
FIG. 6 is a control block diagram for an image forming system.

FIG. 6 is a control block diagram illustrating the image forming system in FIG. 1. A printer control unit 350 includes a central processing unit (CPU) 351, a read-only memory (ROM) 352, and a random-access memory RAM 353. Likewise, a finisher control unit 900 includes a CPU 901, a ROM 902, and a RAM 903. The CPU 901 controls the folding conveyance motor 907, the clamp motor 909, the press motor 910, and the like by a control program stored in the ROM 902. The finisher control unit 900 performs communication with the printer control unit 350, so that it receives information on print job and information on the sheets conveyed from the printer control unit 350.

Referring to FIG. 7, the movement of the press roller pairs 861 of the press unit 860 will be described.

As illustrated in FIG. 7, a movement speed of the press unit is set according to the number of sheets forming the sheet bundle. When the number of bundle sheets is 2 to 4, it is set to a speed V1; when the number of bundle sheets is 5 to 9, it is set to a speed V2; when the number of bundle sheets is 10 to 14, it is set to a speed V3; when the number of bundle sheets is 15 to 19, it is set to a speed V4; and when the number of bundle sheets is 20 to 25, it is set to a speed V5 (V1>V2>V3>V4>V5). The smaller the number bundle sheets, the higher the movement speed, and, the larger the number of bundle sheets, the lower the movement speed.

The larger the number of bundle sheets, the more subject to swelling the fold line portion, so that, when the number of sheets is larger, the press roller pairs 861 move at the lower speed, thus, the pressing processing can be executed in a sufficiently long time to strengthen the folding. In the case where the number of bundle sheets is small, the swelling of the fold line portion occurs to a small degree, so that the folding is sufficiently strengthened through the pressing processing in a short time. Further, in the case where the number of bundle sheets is small, the sheet bundles are conveyed at shorter intervals, so that movement at high speed is required to maintain high productivity.

In performing the pressing processing, it is possible to adopt a method in which the press roller pairs 861 repeats moving a predetermined amount along the fold line portion of the sheet bundle and stopping there for a predetermined period of time. Since the processing time performed on the fold line portion of the sheet bundle is increased, the processing can provide the same effect.

Figure 8:
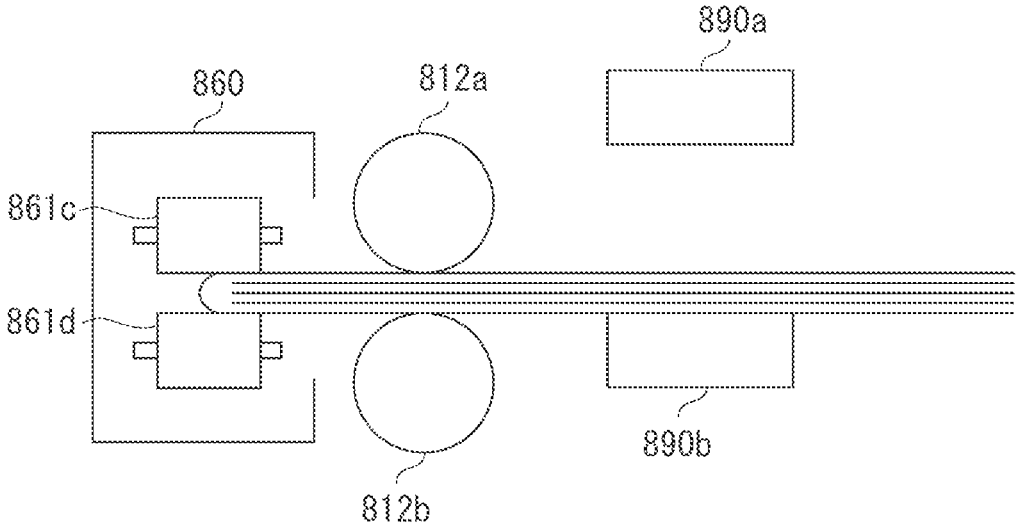
FIG. 8 is a sectional view for illustrating the pressing processing.

Next, the pressing operation will be described in detail. FIG. 8 illustrates how the pressing processing is performed when the number of bundle sheets is less than a predetermined number (which is 10 sheets in this case). When the number of bundle sheets is less than 10, the pressing processing is executed without grasping of the sheet bundle by the clamp members 890. It has been clarified through an experiment that when the number of bundle sheets is less than 10, no ripping occurs at the stapled portion on a cover sheet without performing sheet grasping by the clamp members 890.

The grasping of the sheet bundle by the clamp members 890 involves the requisite operation time. When the number of bundle sheets is small, the time interval between the sheet bundles conveyed is short, so that performing the clamping operation would make it impossible to retract the clamp member 890 in that short time. More specifically, a surplus processing time is needed for the clamping operation, and it is impossible to receive the next bundle until the retraction of the clamp member 890 is completed. As a result, productivity may be deteriorated. Accordingly, when the number of bundle sheets is less than 10, the sheet grasping by the clamp members is not performed in order to maintain high productivity.

On the other hand, when the number of bundle sheets is not less than a predetermined number (not less than 10), it is possible to complete retraction of the clamp member within the time interval between the sheet bundles conveyed, so that the clamping operation does not affect productivity. Thus, when the number of bundle sheets is 10 or more, the clamping operation by the clamp members 890 is performed.

Referring to FIGS. 5A and 5B, a description will be given of the operation when the pressing processing is performed on the fold line portion of the sheet bundle whose number of bundle sheets is not less than a predetermined number (i.e. 10 sheets). When the number of bundle sheets is not less than 10, the clamp members 890 perform the sheet grasping in order to operate the press roller pairs 861 with the sheet bundle fixed in position. By executing the pressing processing while grasping the sheet bundle by the clamp members 890, there is no fear of the cover being pulled by the pressure of the press roller pairs 861, thus occurrence of cover ripping can be prevented. When the number of bundle sheets is not less than 10, the requisite time for sheet stacking processing, stitching processing, and folding processing in the saddle stitch bookbinding unit 800 is longer than the requisite time for the operation of the clamp member 890, which means the increase in processing time due to the clamping operation does not affect productivity.

Next, the bookbinding processing executed by the CPU 901 of the finisher control unit 900 according to the first exemplary embodiment will be described with reference to the flowchart of FIG. 9. When the bookbinding processing is started, in step S1100, the CPU 901 causes the accommodation guide 803 to stack a plurality of sheets thereon. In step S1101, the CPU 901 causes the stapler 802 to perform stitching processing on the sheet bundle stacked on the accommodation guide 803. In step S1102, the CPU 901 causes the pushing member 830 and the folding roller pair 810 to fold the sheet bundle that has undergone the stitching processing in the middle.

Then in steps S1103 and S1104, the CPU 901 causes the first folding conveyance roller pair 811 and the second folding conveyance roller pair 812 to convey the sheet bundle that has undergone the stitching processing to the press unit 860 and stop it there. Next in step S1105, the CPU 901 determines based on job information transmitted from the printer control unit 350 as to whether the number of bundle sheet is 10 or more.

If the number of bundle sheets is less than 10 (NO in step S1105), then in step S1106, the CPU 901 starts to drive the press motor 910 to move the press roller pairs 861. Accordingly, the pressing processing is executed on the sheet bundle. When the pressing processing is completed, in step S1107, the CPU 901 discharges the sheet bundle onto the folded sheet bundle discharge tray 850.

The determination as to whether the pressing processing has been completed or not can be made by determining whether the press roller pairs 861 have moved by a predetermined amount. The movement amount of the press roller pairs 861 can be determined by counting pulses from an encoder (not illustrated) provided on the press motor 910.

If the number of bundle sheets is 10 or more (YES in step S1105), then in step S1108, the CPU 901 operates the clamp members 890 by the clamp motor 909 to grasp the sheet bundle. In step S1109, the CPU 901 moves the press roller pairs 861 to execute the pressing processing on the sheet bundle fixed in position by the clamp members 890. In other words, the CPU 901 functions as a control unit for operating the clamp members according to the number of bundle sheets.

When the pressing processing is completed, in step S1110, the CPU 901 causes the clamp motor 909 to release the grasping by the clamp members 890, and discharges the sheet bundle onto the folded sheet bundle discharge tray 850. In step S1111, the CPU 901 determines whether the discharged bundle is a final bundle of the job. If it is the final bundle (YES in step S1111), the CPU 901 completes the bundle preparation job. Or, if it is not the final bundle (NO in step S1111), the CPU 901 returns the processing to step S1100 to repeat the above-described bundle preparation processing on the next sheet.

As described above, according to the present exemplary embodiment, the pressing processing is performed on the sheet bundle that has undergone the saddle stitching and the mid-folding with the sheet bundle fixed in position by the clamp members, so that ripping of the stitched portion of the cover of the sheet bundle can be prevented. Further, when the number of bundle sheets is less than a predetermined number, the grasping of the sheet bundle by the clamp members is not performed, so that deterioration in productivity due to the clamping operation can be prevented.

Next, a second exemplary embodiment will be described. The second exemplary embodiment has the configuration similar to that in the first exemplary embodiment except for the press unit 860.

Figure 10:
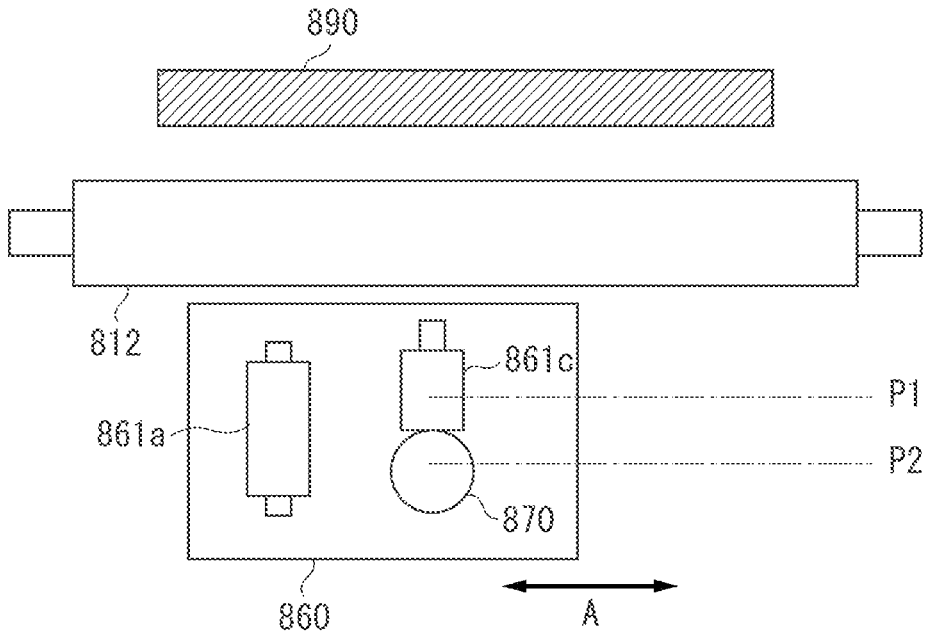
FIG. 10 is a plan view illustrating a press unit according to a second exemplary embodiment.

The press unit according to the second exemplary embodiment will be described with reference to FIG. 10. FIG. 10 is a plan view, as seen from above, of the press unit 860 and the portion in the vicinity thereof. The clamp member 890 is provided on the upstream side of the second folding conveyance roller pair 812. On the downstream side of the second folding conveyance roller pair 812, there is provided the press unit 860. The press unit 860 moves in the direction of the arrow A, so that the pressing processing is executed on the sheet bundle as described above in the first exemplary embodiment.

Figure 12:
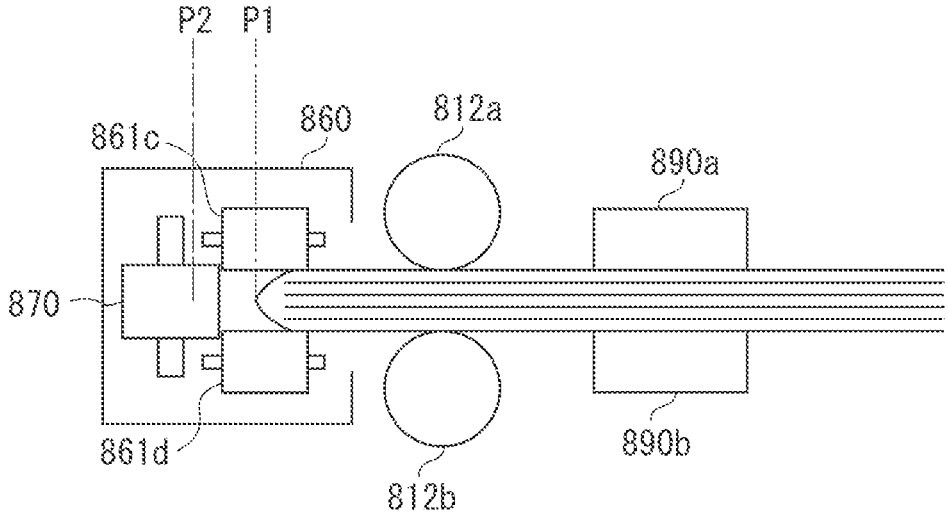
FIG. 12 is a sectional view for illustrating pressing processing according to the second exemplary embodiment.

The press unit 860 is provided with the press roller pairs 861*a* through 861*d* and a squeezing roller 870. The squeezing roller 870 is a roller which applies pressure on the fold line portion of the sheet bundle from the downstream side to the upstream side in the conveyance direction to turn the sheet fold line portion into a flat surface perpendicular to the conveyance direction. FIG. 12 is a sectional view, as seen sidewise, of the squeezing roller 870 and the press roller pairs 861. When processing is performed on the fold line portion by the squeezing roller 870, the clamp members 890 grasp the sheet bundle in order to prevent the sheet bundle from moving in a direction opposite to the conveyance direction, thus firmly keeping the sheet bundle fixed in position.

The processing on the fold line portion of the sheet bundle can be selected between the pressing processing by the press roller pairs 861 alone and the processing by the press roller pairs 861 and the squeezing roller 870. In the case where the sheet bundle is stopped at a position P1, the pressing processing is performed on the fold line portion by the press roller pair 861. In the case where the sheet bundle is stopped at a position P2, the pressing processing and squeezing processing are performed on the fold line portion by the press roller pairs 861 and the squeezing roller 870. When the sheet bundle is stopped at the position P2, the squeezing roller 870 pushes in the fold line portion of the sheet bundle. The squeezing processing is performed on the fold line portion by the amount by which the pushing-in has been effected. At the time of the squeezing processing, the pressing processing by the pressing roller pairs 861 is also performed in parallel.

Figure 11:
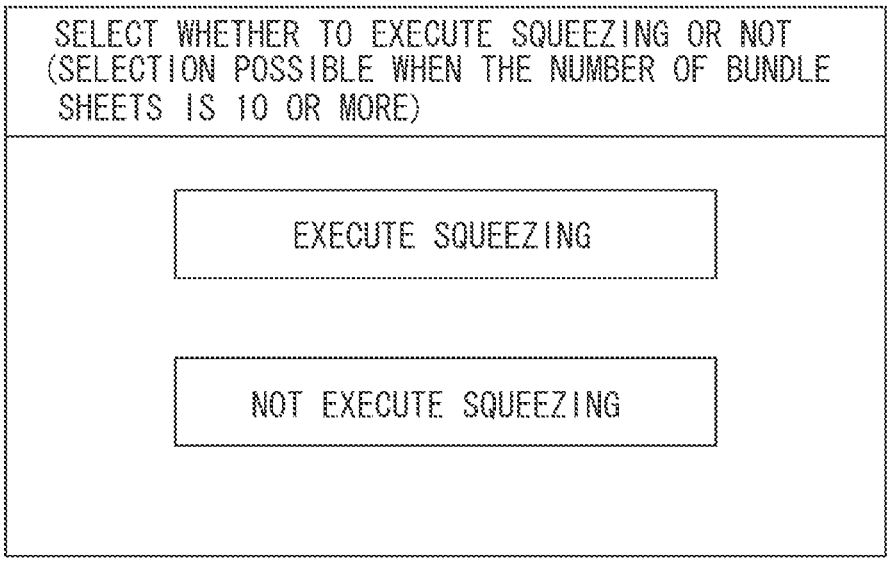
FIG. 11 illustrates a setting screen of an operation unit.

In the present exemplary embodiment, the squeezing processing on the folding portion by the squeezing roller 870 can only be executed when the number of bundle sheets is 10 or more. This is because that if the number of bundle sheets is too small, the appearance quality of the fold line portion of the sheet bundle is deteriorated by the squeezing processing by the roller 870. In the case where the number of bundle sheets is 10 or more, the present exemplary embodiment enables a user to select between execution and non-execution of the squeezing processing. FIG. 11 illustrates an example of a screen on the operation unit 990 for selecting the squeezing processing.

Next, the operation of the pressing processing and the squeezing processing will be described. As in the first exemplary embodiment, if the number of bundle sheets is less than 10, the pressing processing is performed without grasping the sheet bundle by the clamp members 890. When the number of bundle sheets is 10 or more and execution of the squeezing processing is not selected, the leading edge of the sheet bundle is stopped at the position P1 as illustrated in FIG. 12, and the press roller pairs 861 press the fold line portion, with the sheet bundle grasped by the clamp members 890. At this time, the squeezing roller 870 is situated on the downstream side of the fold line portion of the sheet bundle, and the does not come into contact with the fold line portion of the sheet bundle, so that no squeezing processing is performed. The reason for grasping the sheet bundle by the clamp member 890 is as described in the first exemplary embodiment. Thus, the clamp members 890 prepared for the squeezing processing can also be utilized at the time of the pressing processing.

Figure 13:
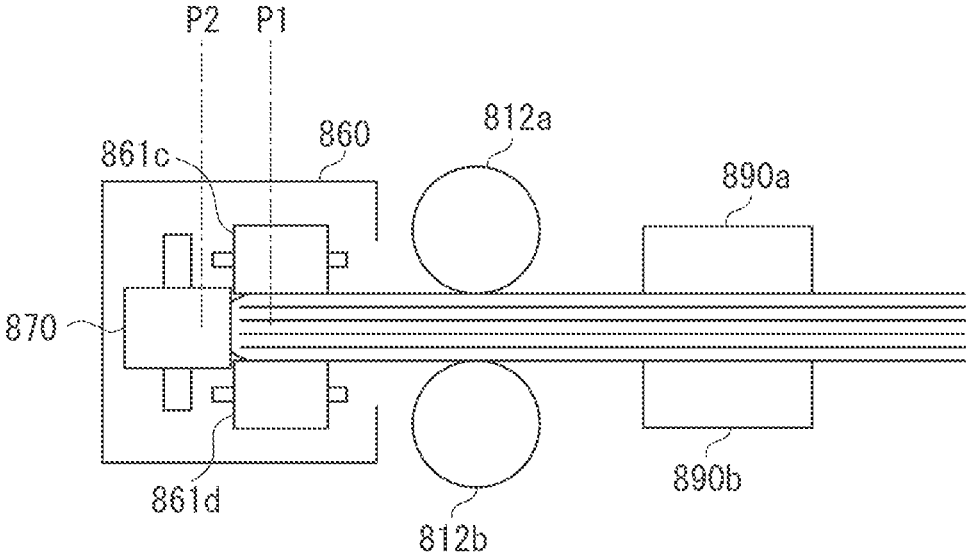
FIG. 13 is a sectional view for illustrating the pressing processing and squeezing processing according to the second exemplary embodiment.

When the number of bundle sheets is 10 or more and execution of squeezing processing is selected, the leading edge of the sheet bundle is stopped at the position P2 as illustrated in FIG. 13. The press roller pairs 861 press the fold line portion, and the squeezing roller 870 squeezes the top portion of the fold line portion.

Figure 14:
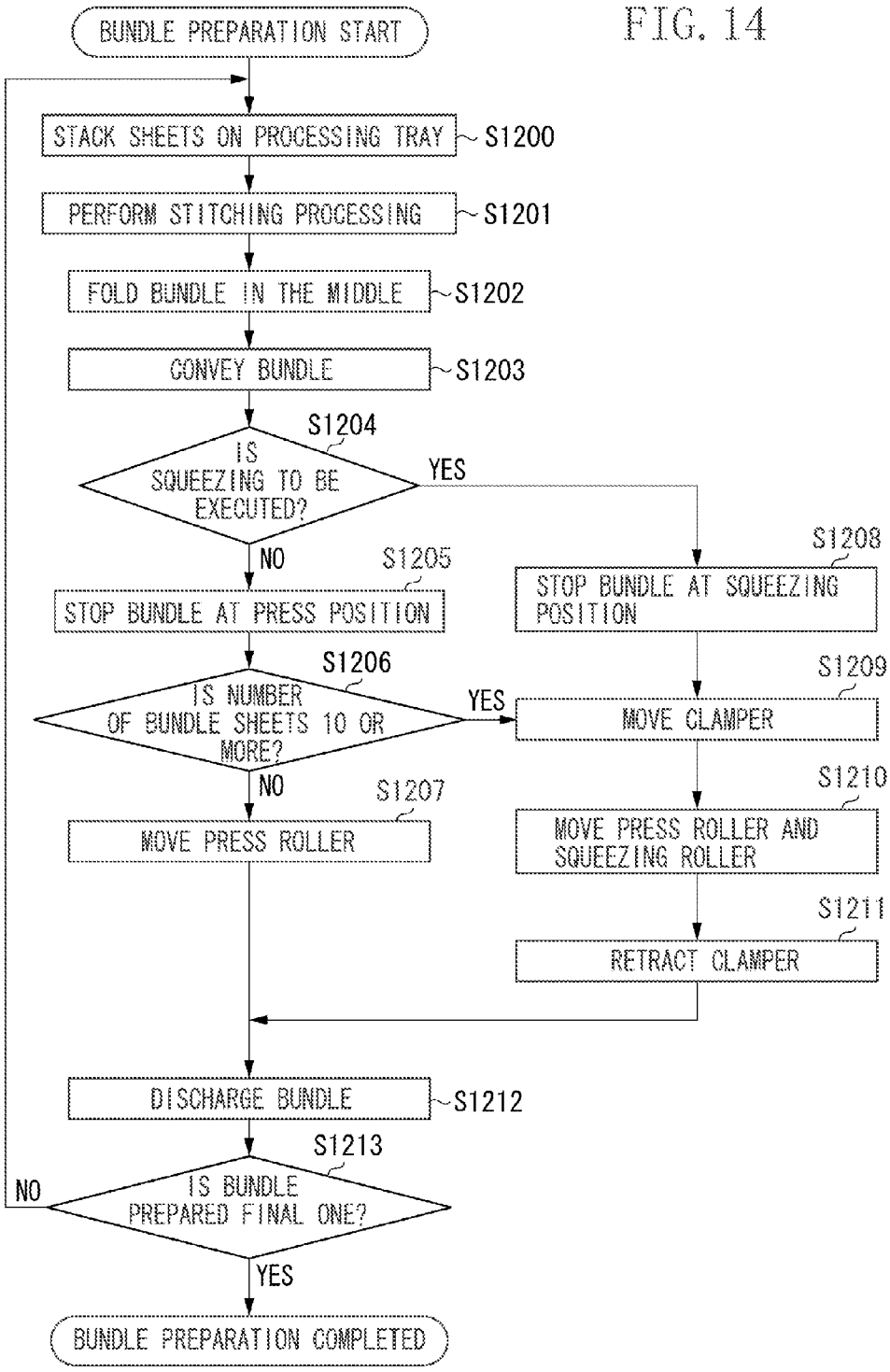
FIG. 14 is a flowchart illustrating bookbinding processing according to the second exemplary embodiment.

Next, the bookbinding processing executed by the CPU 901 of the finisher control unit 900 in the second exemplary embodiment will be described with reference to the flowchart of FIG. 14.

Figure 9:
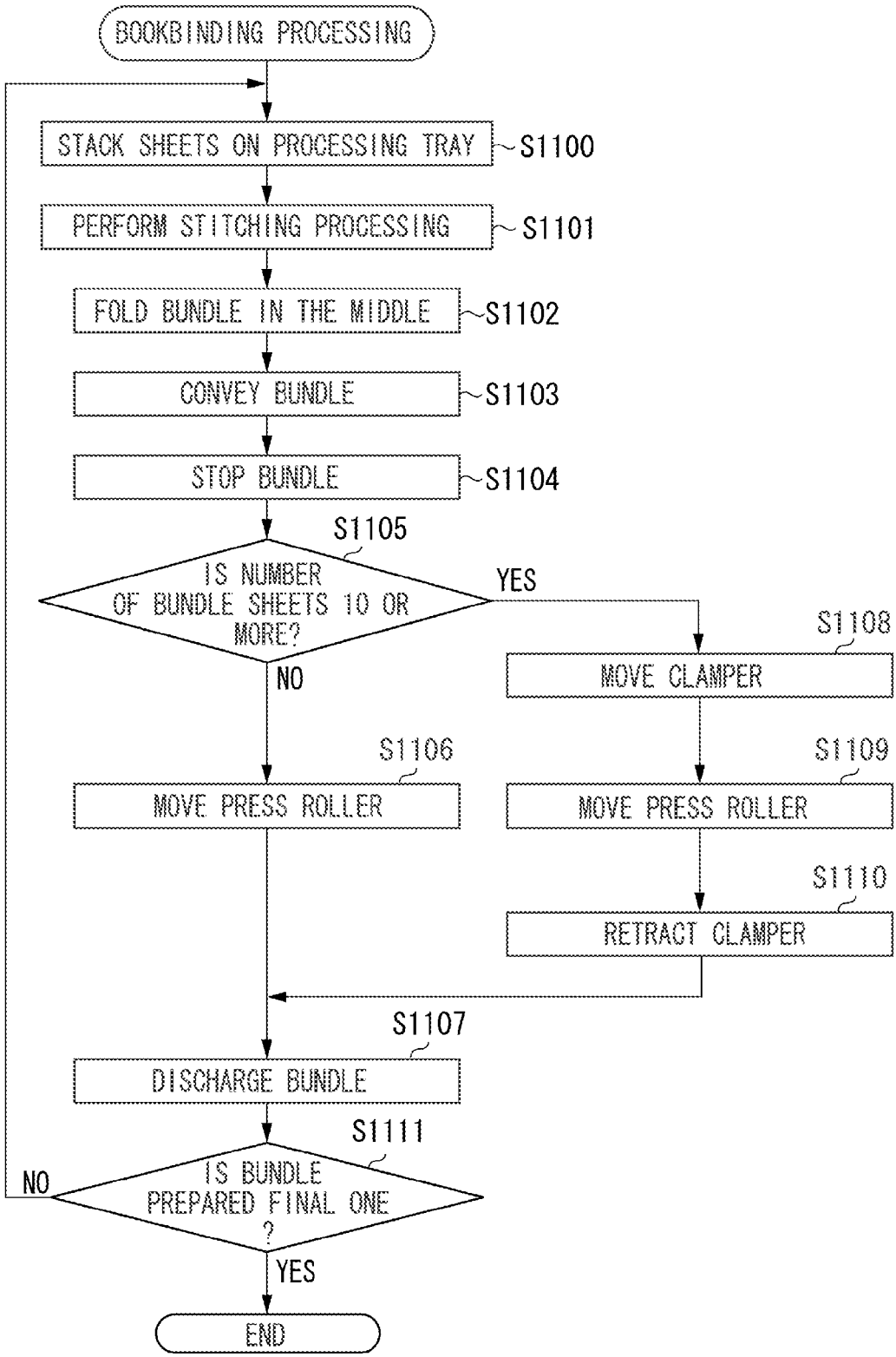
FIG. 9 is a flowchart illustrating bookbinding processing.

The operations performed in steps S1200 to S1203 are the similar to those of steps S1100 to S1103 in FIG. 9 according to the first exemplary embodiment, respectively. At the time of sheet bundle conveyance in step S1203, in step S1204, the CPU 901 determines whether execution of the squeezing processing on the sheet bundle is selected or not. The determination is made based on information supplied from the printer control unit 350.

When the squeezing processing is not to be executed (NO in step S1204), in step S1205, the CPU 901 stops the sheet bundle at the position P1 (pressing position). Then in step S1206, the CPU 901 determines whether the number of bundle sheets is not less than 10 based on job information supplied from the printer control unit 350.

The processing executed when the number of bundle sheets is less than 10 and when it is 10 or more (steps S1205 through S1207, S1212, and S1213) is the similar to those in steps S1106 through S1111 of the first exemplary embodiment illustrated in FIG. 9.

If it is determined that execution of the squeezing processing is selected (YES in step S1204), then in step S1208, the CPU 901 stops the sheet bundle at the position P2 (squeezing position). After the sheet bundle is stopped, in step S1209, the CPU 901 causes the clamp members 890 to grasp the sheet bundle. Then in step S1210, the CPU 901 moves the press roller pairs 861 to execute the pressing processing, and moves the squeezing roller 870 to execute the squeezing processing at the same time.

After the completion of the pressing processing and squeezing processing, in step S1211, the CPU 901 retracts the clamp member 890, and then processing in steps S1212 and S1213 described above are executed.

In the second exemplary embodiment, a threshold value of the number of bundle sheets for determining whether execution of squeezing processing can be selected or not and a threshold value for determining whether the grasping of the sheet bundle (clamping operation) by the clamp members at the time of pressing processing is performed or not, are as illustrated in FIG. 15A. More specifically, the squeezing processing can be selected when the number of bundle sheets is 10 or more. The grasping of the sheet bundle by the clamping operation at the time of pressing processing is also forcibly executed when the number of bundle sheets is 10 or more. If the number of bundle sheets is less than 10, the pressing processing is executed without performing the clamping operation.

When the number of bundle sheets is not less than 10 and the squeezing processing is not set, the clamping operation is performed, and the pressing processing is executed on the fold line portion. When the number of bundle sheets is not less than 10 and the squeezing processing is set, the clamping operation is performed and the pressing processing and the squeezing processing are executed on the fold line portion.

While in the above example the threshold value for determining whether the squeezing processing can be selected and the threshold value for determining whether the clamping operation is performed is 10 sheets, the threshold value can be changed according to the configuration of each apparatus.

Apart from the condition illustrated in FIG. 15A, the operation under conditions as illustrated in FIG. 15B may be possible. For example, if the number of sheets undergoing image formation per unit time of the image forming apparatus connected to the upstream side of the finisher 500 is small (i.e., when the productivity is low), and the requisite processing time for the clamping operation can be secured even when the number of bundle sheets is eight, the clamping operation is performed when the number of bundle sheets is eight or more. The selection of the squeezing operation is possible when the number of bundle sheets is 10 or more. The clamping operation at the time of the pressing processing is conducted when the number of bundle sheets is eight or more.

At this time, when the number of bundle sheets is less than eight, the pressing processing is executed without performing the clamping operation. When the number of bundle sheets is 8 or more and less than 10, the pressing processing is executed while performing the clamping operation. When the number of bundle sheets is not less than 10 and the squeezing processing is not set, the pressing processing is executed while performing the clamping operation. When the number of bundle sheets is not less than 10 and the squeezing processing is set, the pressing processing and squeezing processing are executed while performing the clamping operation.

Further, the operation under the conditions as illustrated in FIG. 15C may be possible. For example, if the number of sheets undergoing image formation per unit time of the image forming apparatus connected to the upstream side of the finisher 500 is large (i.e., when the productivity is high), and it is possible to secure the requisite processing time for the clamping operation when the number of bundle sheets is 12 or more, the clamping operation is conducted when the number of bundle sheets is 12 or more. The squeezing operation can be selected when the number of bundle sheet is 10 or more. The clamping operation at the time of the pressing processing is executed when the number of bundle sheets is 12 or more.

At this time, when the number of bundle sheets is less than 10, the pressing processing is executed without performing the clamping operation. When the number of bundle sheets is 10 or more and less than 12, and the squeezing processing is not set, the pressing processing is executed without performing the clamping operation. When the number of bundle sheets is 10 or more and less than 12, and the squeezing processing is set, the pressing processing and squeezing processing are executed while performing the clamping operation. When the number of bundle sheets is not less than 12 and the squeezing processing is not set, the pressing processing is executed while performing the clamping operation. When the number of bundle sheets is not less than 12 and the squeezing processing is set, the pressing processing and squeezing processing are executed while performing the clamping operation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-113562 filed May 17, 2010, which is hereby incorporated by reference herein in its entirety.

What is claimed is:

1. A sheet processing apparatus comprising:

a sheet stacking unit in which a sheet bundle is stacked;

a binding unit configured to perform binding processing on the sheet bundle stacked in the sheet stacking unit;

a folding unit configured to fold the sheet bundle that is subjected to binding processing by the binding unit;

a conveyance unit configured to convey the sheet bundle folded by the folding unit;

a press unit configured to press a fold line portion of the sheet bundle conveyed by the conveyance unit;

a grasping unit provided separately from the conveyance unit and configured to be switched between a first state in which the grasping unit grasps the conveyed sheet bundle to fix the sheet bundle in position and a second state in which the grasping unit does not grasp the conveyed sheet bundle; and a control unit configured to cause the press unit to perform pressing on the sheet bundle without causing the grasping unit to grasp the sheet bundle in response to a number of bundle sheets being less than a predetermined number, and cause the press unit to perform pressing on the sheet bundle while causing the grasping unit to grasp the sheet bundle in response to the number of bundle sheets being equal to or greater than the predetermined number.

2. The sheet processing apparatus according to claim 1, wherein the press unit includes a roller configured to move along the fold line portion of the sheet bundle while applying pressure to the fold line portion.

3. The sheet processing apparatus according to claim 2, wherein the press unit presses the fold line portion from a direction perpendicular to a surface of a front page of the sheet bundle.

4. The sheet processing apparatus according to claim 1, wherein the grasping unit includes grasping members configured to hold the sheet bundle between the grasping members.

5. The sheet processing apparatus according to claim 1, further comprising:

a squeeze unit configured to squeeze the fold line portion of the sheet bundle by pressing the fold line portion from a direction parallel to a surface of a front page of the sheet bundle, wherein, in response to the squeeze unit squeezing the fold line portion, the control unit causes the grasping unit to grasp the sheet bundle regardless of a number of bundle sheets.

6. A sheet processing apparatus, comprising:

a conveyance unit configured to convey a sheet bundle that is subjected to saddle bind processing;

a press unit configured to press a fold line portion of the sheet bundle conveyed by the conveyance unit;

a grasping unit configured to be switched between a first state in which the grasping unit grasps the sheet bundle to fix the sheet bundle in position and a second state in which the grasping unit does not grasp the sheet bundle; and a control unit configured to cause the press unit to perform pressing on the sheet bundle without causing the grasping unit to grasp the sheet bundle in response to a number of bundle sheets being less than a predetermined number, and cause the press unit to perform pressing on the sheet bundle while causing the grasping unit to grasp the sheet bundle in response to the number of bundle sheets being equal to or greater than the predetermined number.

7. The sheet processing apparatus according to claim 6, wherein the press unit includes a roller configured to move along the fold line portion of the sheet bundle while applying pressure to the fold line portion.

8. The sheet processing apparatus according to claim 7, wherein the press unit presses the fold line portion from a direction perpendicular to a surface of a front page of the sheet bundle.

9. The sheet processing apparatus according to claim 6, wherein the grasping unit includes grasping members configured to hold the sheet bundle between the grasping members.

10. The sheet processing apparatus according to claim 6, further comprising:

a squeeze unit configured to squeeze the fold line portion of the sheet bundle by pressing the fold line portion from a direction parallel to a surface of a front page of the sheet bundle, wherein, in response to the squeeze unit squeezing the fold line portion, the control unit causes the grasping unit to grasp the sheet bundle regardless of a number of bundle sheets.

* * * * *